US005675107A

United States Patent [19]

Ledys et al.

[11] Patent Number: 5,675,107

[45] Date of Patent: Oct. 7, 1997

[54] MUZZLE BRAKE FOR MEDIUM OR LARGE CALIBER CANNONS

[75] Inventors: Francis Ledys, Villeneuve S/Cher; Regis Dupuy; Nicolas Brunet, both of La Chapelle St. Ursin, all of France

[73] Assignee: Giat Industries, Versailles, France

[21] Appl. No.: 586,974

[22] Filed: Jan. 16, 1996

[30] Foreign Application Priority Data

Jan. 18, 1995 [FR] France ..... 95 00492

[51] Int. Cl.[6] ..... F41A 21/36

[52] U.S. Cl. ..... 89/14.3; 89/14.05

[58] Field of Search ..... 89/14.3, 14.05; 42/1.06

[56] References Cited

U.S. PATENT DOCUMENTS

| | | | |
|---|---|---|---|
| 1,363,058 | 12/1920 | Schneider | 89/14.3 |
| 3,141,376 | 7/1964 | Chinn | 89/14.3 |
| 3,492,912 | 2/1970 | Ashbrook | 89/14.3 |
| 4,307,652 | 12/1981 | Witt et al. | 89/14.3 |
| 4,545,285 | 10/1985 | McLain | 89/14.3 |
| 5,119,716 | 6/1992 | Bartolles | 89/14.3 |
| 5,333,529 | 8/1994 | Brockman | 89/14.3 |

FOREIGN PATENT DOCUMENTS

| | | | |
|---|---|---|---|
| 715769 | 12/1931 | France | 89/14.3 |
| 772162 | 10/1934 | France | 89/14.3 |
| 812680 | 5/1937 | France | 89/14.3 |
| 2507765 | 12/1982 | France . | |
| 46859 | 4/1909 | Switzerland | 89/14.3 |

*Primary Examiner*—Stephen M. Johnson
*Attorney, Agent, or Firm*—Oliff & Berridge

[57] ABSTRACT

A muzzle brake for a large or medium caliber barrel. The muzzle brake has a body whose inner dimensions are substantially greater than those of the barrel and which is fitted with at least one stage of two openings prolonged by vanes upon which the propellant gases are applied to create a force in the opposite direction to that generated by these gases. The muzzle brake comprises a tubular component prolonging the free end of the barrel, that is engaged in the body and pierced with several vents directing the propellant gases towards the vanes. The diameter of the tubular component is roughly between the caliber of the barrel and the diameter at the bottom of the rifling grooves of the barrel.

13 Claims, 7 Drawing Sheets

MUZZLE BRAKE FOR MEDIUM OR LARGE CALIBER CANNONS

BACKGROUND OF THE INVENTION

The scope of application of the present invention is that of muzzle brakes for large or medium calibre barrels mounted on a top carriage or turret and in particular those firing sub-calibre projectiles.

To reduce the stresses generated by firing and transmitted to the top carriage or turret, it is well known to use a muzzle brake at the end of the barrel which creates a counter-stress to that generated by firing. This stress is produced by channeling a part of the propellant gases towards vanes as is explained in patent FR-A-510 111. The muzzle brake in this document is formed of a part having a hole which is screwed on to the end of the barrel upon which another part is fitted forming a vane.

In the event that sub-calibre kinetic energy projectiles are fired, of the discarding-sabot type for example, it is primordial to obtain a high initial velocity of the projectile (in the region of 1300–1500 $m.s^{-1}$) as a result of which the weapon is subjected to very great stresses which must be reduced.

To do this, a muzzle brake is known by French patent FR-A-2 507 765. This muzzle brake has an inner diametre which is much greater than the calibre of the weapon barrel and it has very high energy efficiency (quotient between the recoil energy of the weapon with and without a muzzle brake), of somewhere around 50 to 60%. But, in the case of a rifled barrel, the sabots driving the sub-calibre projectile tend to become detached from the latter during their passage in the muzzle brake, this phenomenon being all the greater in that the rifling angle of the barrel is high since the centrifugal force to which the different parts of the sabot is subjected is greater. This opening of the sabot causes disturbances between the projectile and the muzzle brake which in turn lead to the destabilization of the projectile and a loss of efficiency.

To avoid this phenomenon, it is usual to increase the diametre of the passage in the muzzle brake, but that seriously reduces its efficiency which increases the stresses on the bearing frame of the weapon.

Other models of muzzles brakes are known of the multi-stage type such as described in patent U.S. Pat. No. 5,119,716. These have the disadvantage of having a heavy mass the effect of which is the creation of a strong unbalance couple on the barrel which prejudices the rapidity and steering accuracy of the weapon.

The aim of the present invention is to supply a muzzle brake with high energy efficiency, of a reduced mass and which is able to fire sub-calibre projectiles without causing any disturbance to them.

SUMMARY OF THE INVENTION

The subject of the invention is thus a muzzle brake of a medium or large calibre barrel having a body whose inner dimensions are much greater than the calibre of the barrel, fitted with at least one stage of two openings prolonged by vanes upon which the propellant gases are applied in order to create a force in the opposite direction to that generated by these gases, characterised in that it comprises a tubular component prolonging the free end of the barrel engaged in the muzzle brake, pierced with several vents which direct the propellant gases towards the vanes, the inner diametre d1 of this component being roughly between the calibre d2 of the barrel and the diametre d3 at the bottom of the barrel rifling.

According to one characteristic of the invention, the inner wall of the tubular component is smooth, and its inner diametre d1 is equal to the calibre d2 of the barrel.

According to one characteristic of the invention, the inner wall of the tubular component is smooth and its inner diametre d1 is equal to the diametre d3 at the bottom of the barrel rifling.

According to one characteristic of the invention, the inner wall of the tubular component has rifling identical to that of the barrel.

According to another characteristic of the invention, the vents have a cylindrical inner profile of a diametre of between 10 and 20 mm inclined at an angle $\alpha 1$ with respect to the axis of the barrel, roughly equal to the slope $\alpha 2$ of the inner wall of the body with respect to the barrel axis.

According to another characteristic of the invention, the vents have an ovoid inner profile with a large axis of roughly between 15 and 40 mm and a small axis of between 10 and 15 mm, inclined at an angle $\alpha 3$ with respect to the barrel axis, roughly equal to the slope $\alpha 2$ of the inner wall of the body of the muzzle brake with respect to the axis of the barrel.

According to a further characteristic of the invention, the vents have a cylindrical profile of a diametre of between roughly 10 and 20 mm opening out onto the inner side of the tubular component, and a tapered profile opening out onto the outer side of the said tubular component inclined at an angle $\alpha 4$ with respect to the axis of the barrel roughly equal to the slope $\alpha 2$ of the inner wall of the body with respect to the axis of the barrel.

According to a further characteristic of the invention, the tubular component is in the shape of a liner of a thickness of between 5 and 10 mm made of steel having an elastic limit of around 1000 MPa.

According to a further characteristic of the invention, the liner is centred on the barrel axis by means of guiding supports at the ends which work in conjunction with receiving supports made on the inner wall of the body.

According to another characteristic of the invention, the tubular component is immobilized with respect to the muzzle brake body by an immobilizing means formed, for example, of a key.

According to another characteristic of the invention, the tubular component is adjusted and immobilized in rotation with respect to the barrel by means of a key screwed in the body of the muzzle brake which works in conjunction with a groove made in the tubular component and another groove made in the barrel.

According to another characteristic of the invention, the tubular component is immobilized in translation with respect to the barrel by means of two shoulders made, firstly, on the front end of the component and, secondly, on the front part of the muzzle brake body, adjusting wedges possibly being housed between these two shoulders.

According to yet another characteristic of the invention, the tubular component and the body of the muzzle brake can be made in a single piece from a casting blank, for example.

According to yet another characteristic of the invention, the barrel and the tubular component form a single piece.

A first advantage of the muzzle brake according to the invention lies in its great energy efficiency and thus in the possibility it provides for the weapon system to fire high energy ammunition.

Another advantage of this muzzle brake is in its capacity to fire a sub-calibre projectile without causing any disturbance to the latter.

Another advantage lies in the fact that the reduced mass of the muzzle brake facilitates laying the weapon.

BRIEF DESCRIPTION OF THE DRAWINGS

Other characteristics and advantages of the invention will become more apparent from the description given hereafter by way of illustration and with reference to the drawings, in which.

DESCRIPTION OF PREFERRED EMBODIMENTS

Figure 1:
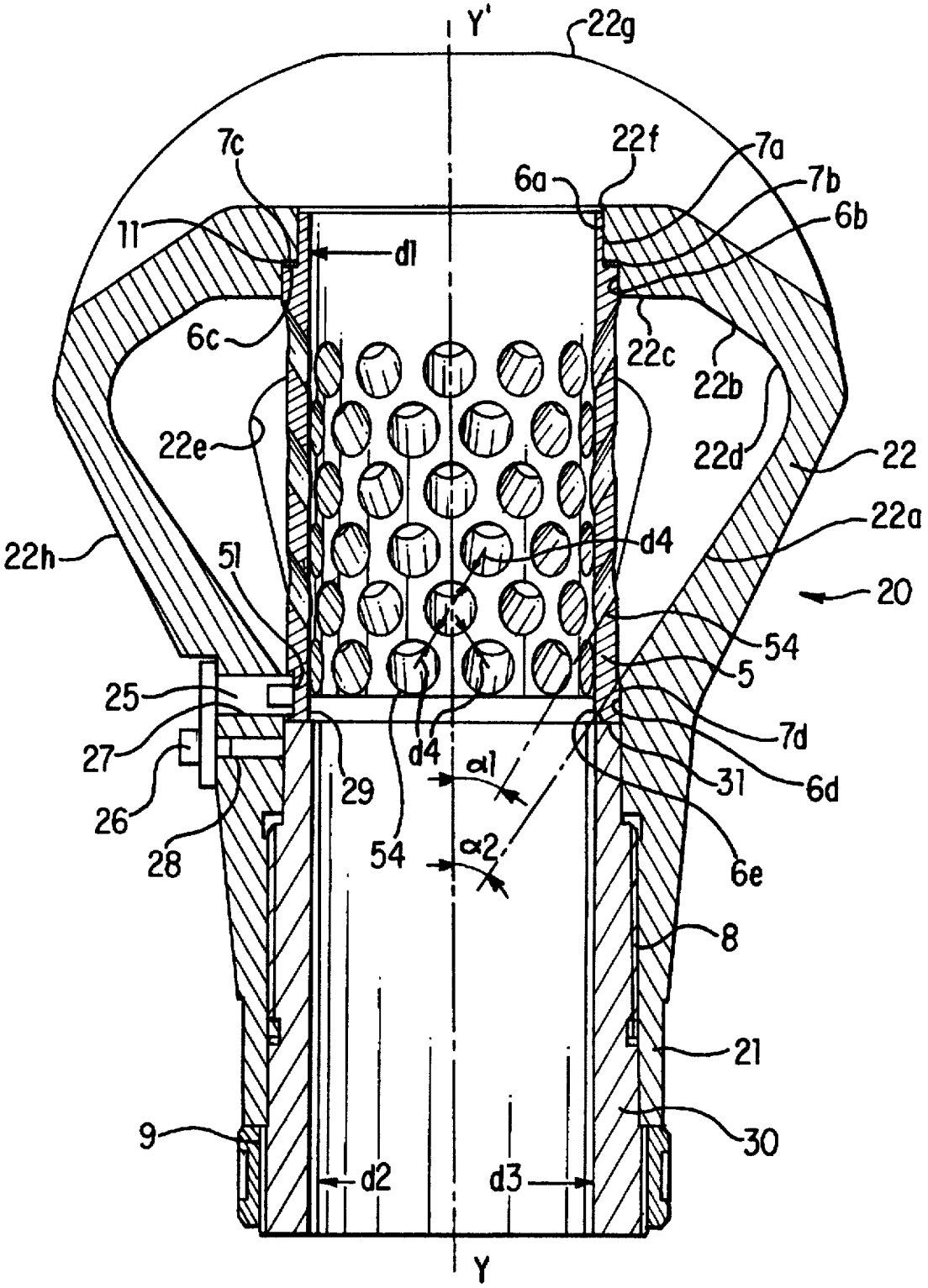
FIG. 1 shows a cross-section of a muzzle brake fitted with a smooth liner.

FIG. 1 shows an embodiment of the invention of a muzzle brake, called single stage, that is to say having a single row of vanes and commonly called a "tulip" muzzle brake. This muzzle brake 20 is divided into a cylindrical part 21 connected to the barrel 30 by a threaded connection 8, secured by a locknut 9 system and adjusted in a known manner by a key (not shown) with respect to the barrel 30, and a body 22 fitted with vanes **22*b* upon which the propellant gases come to bear to generate a force in the opposite direction to that generated when the munition is fired, with openings 22*e* to expand these propellant gases and eject them towards the outside and an exit opening for the projectile 22*f***.

The inner part of the body is formed of a divergent tapered part **22*a* followed by a convergent part 22*b* forming the vanes and of a surface 22*c*, roughly perpendicular to the axis YY' of the barrel, the divergent part 22*a* and the convergent part 22*b* are joined together by a curved surface 22*d*. The outer surface 22*h* of the body 22** is roughly parallel to the inner surfaces of the body.

For the purposes of the mechanical strength of the body 22, a reinforcement **22*g*** forming a beam is placed to the front of the body.

Such a muzzle brake operates as follows: when the ammunition is fired, the projectile moves along the barrel 30 then passes into the body 22 of the muzzle brake 20 and exits by the exit opening **22*f*. Firing the ammunition results in the recoil of the barrel, further to the conservation of linear momentum, towards the rear and in the generation of high stress on the bearing frame of the barrel which may be either a top-carriage or turret. The purpose of the muzzle brake 20 is to reduce the stresses generated on the bearing frame of the barrel. To do this, a large part of the propellant gases is directed, thanks to the divergent surface 22*a*, towards the vanes 22*b* thus creating an aerodynamic force in the opposite direction to that generated when the ammunition is fired. The propellant gases may thereafter escape by the openings 22*e***.

The inner shape of the muzzle brake 20 enables it to have a high energy efficiency, of around 50 to 60%, this being the quotient of the recoil energy of the barrel with and without a muzzle brake.

The disadvantage of the muzzle brake such as described above is clearly apparent in the case of the firing of sub-calibre munitions formed of a core having a small diametre which is propelled from a barrel with a larger calibre by means of a sabot. These sabots merely have internal ballistics functions and are discarded upon barrel exit by the aerodynamic forces which are applied to them or by the centrifugal force which tends to force them apart from the core. The particularly splayed shape of the inner wall of the muzzle brake 20 leaves the sabots free to begin their detachment from the core by one or other of the above forces and thereby to begin to interfere with the exit opening **22*f*. This induces parasite stresses on the core causing it to destabilize and causing the deterioration of the muzzle brake 20**.

In order to meet this disadvantage, the invention proposes the insertion in the body 22 of the muzzle brake 20 of a liner 5 prolonging the free end of the barrel 30 and pierced with several vents 54. The inner wall of the liner 5 is smooth and its diametre d1 is roughly between the calibre d2 of the barrel and the diameter d3 at the bottom of the barrel rifling. However, the diameter d1 can also be, advantageously, equal to the calibre d2 of the barrel 30 when the latter is smooth, or equal to the diametre d3 at the bottom of the barrel rifling when the barrel is rifled.

The liner 5 is centred with respect to the barrel 30 and to the muzzle brake 20 by means of the supports **6*a*, 6*b* on the liner 5 which work in conjunction with the supports 7*a*, 7*b* made in the inner wall of the body 22 and by means of the support 6*d* on the liner 5 which works in conjunction with the support 7*d* made in the barrel 30**.

The liner 5 is also axially positioned with no clearance between the muzzle brake 20 and the barrel 30 by the face **6*a* of the liner 5 which works in conjunction with the front edge 31 of the barrel on the one hand, and on the other by the face 6*c* of the liner 5 which works in conjunction with the face 7*c* of the body 22 and adjusting wedges 11** whose value is determined upon assembly.

The liner 5 is immobilized in rotation with respect to the muzzle brake 20 by means of a key 25 engaged in a groove 27 of the muzzle brake and which works in conjunction with a groove 51 made in the liner 5. This key 25 is connected to the muzzle brake 20 by means of a screw 26 working in conjunction with the said key and a tapping 28 made in the muzzle brake 20.

A bevel 29 made on the inner surface of the liner 5 on the side in contact with the barrel makes it easier for the sabot of the ammunition to pass into the liner.

The liner 5 has an average thickness of 5 to 10 mm and is made of a material which has an elastic limit of around 1000 MPa.

The liner 5 is pierced with vents 54, which open out into the inner volume of the body 22, having a cylindrical shape whose angle $\alpha 1$ with respect to the axis YY' of the barrel 30 is roughly equal to the angle $\alpha 2$ of the wall **22*a* of the body 22 with respect to the said axis YY'. The diametre of the vents 54 is between 10 and 20 mm. There must be as many vents 54** as possible so as to allow the best part of the propellant gases to pass through, however the distance d4 between the vents must be great enough to withstand the pressure of the said propellant gases.

With the muzzle brake 20 according to the invention, the sabots of the sub-calibre projectile remain linked to the core during their passage through the muzzle brake 20 thanks to the liner 5 which is of the same diametre d2 or d3 as the barrel 30. The sabots are freely detached from the core upon exit from the muzzle brake 20 and thus cause no parasite effect upon the core or damage to the muzzle brake 20. The propellant gases are directed by the vents 54 towards the vanes 22*b* so as to generate a force in the opposite direction to that induced by the firing of the ammunition.

Figure 2:
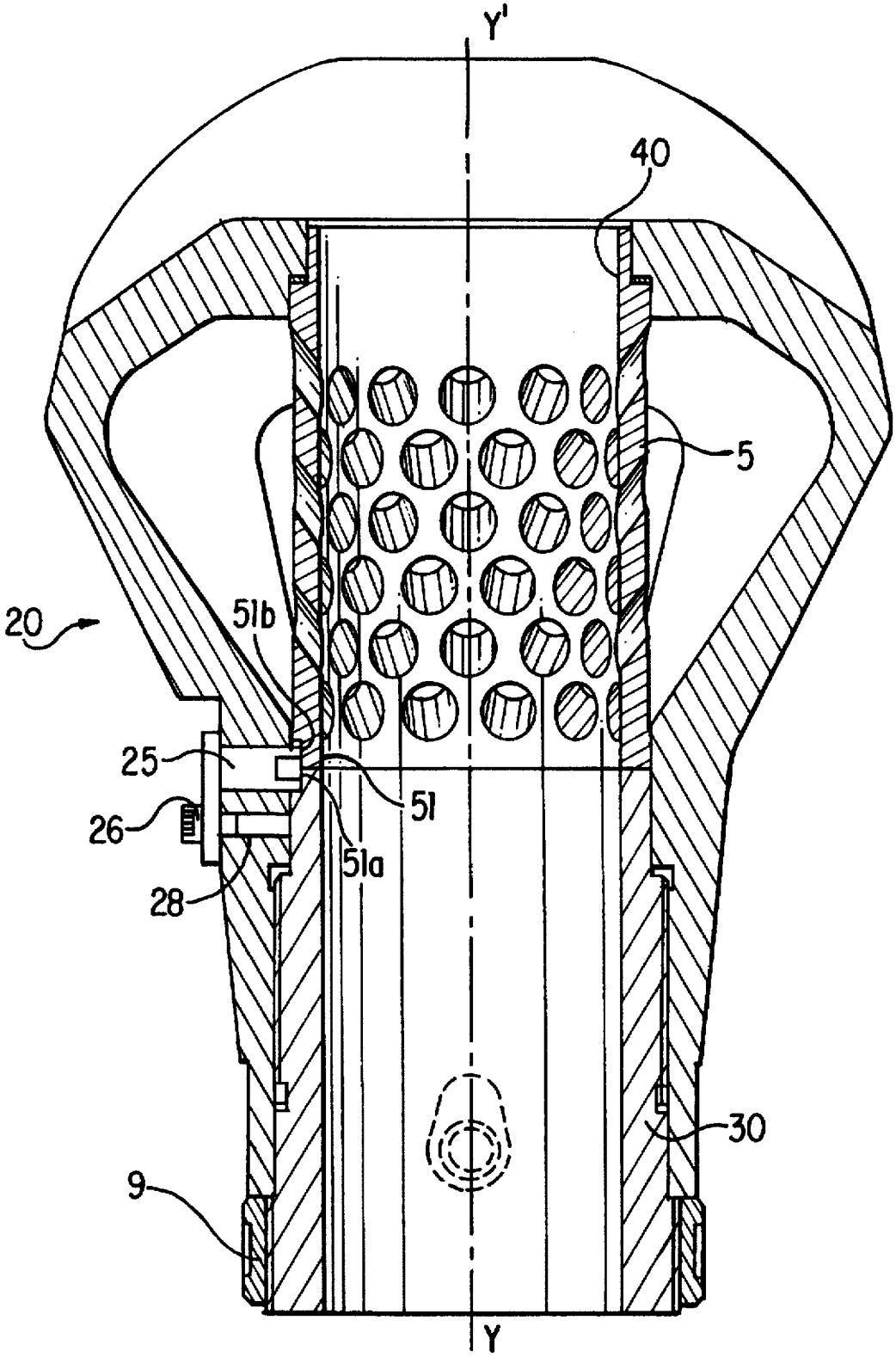
FIG. 2 shows a cross-section of a muzzle brake fitted with a rifled liner.

FIG. 2 shows a muzzle brake according to the invention which is identical to the embodiment shown in FIG. 1, but where the liner 5 is not smooth but is rifled and whose grooves 40 are identical to and prolong those of the barrel 30. In this case, the liner must be adjusted so as to ensure the continuity of the rifling grooves of the barrel 30 and the liner 5. A key 25 carried on the muzzle brake 20 works in conjunction with a groove 51 made partly 51*a* in the barrel 30 and precisely positioned with respect to the rifling grooves of the barrel and partly 51*b* in the liner 5 also precisely positioned with respect to the rifling grooves of the said liner. This key 25 is connected to the muzzle brake 20 by means of a screw 26 working in conjunction with the key 25 and a tapping 28 made in the muzzle brake 20.

This configuration enables the rotation of the projectile to be maintained during its passage through the muzzle brake 20 thereby providing greater stabilization during its trajectory.

Figure 3:
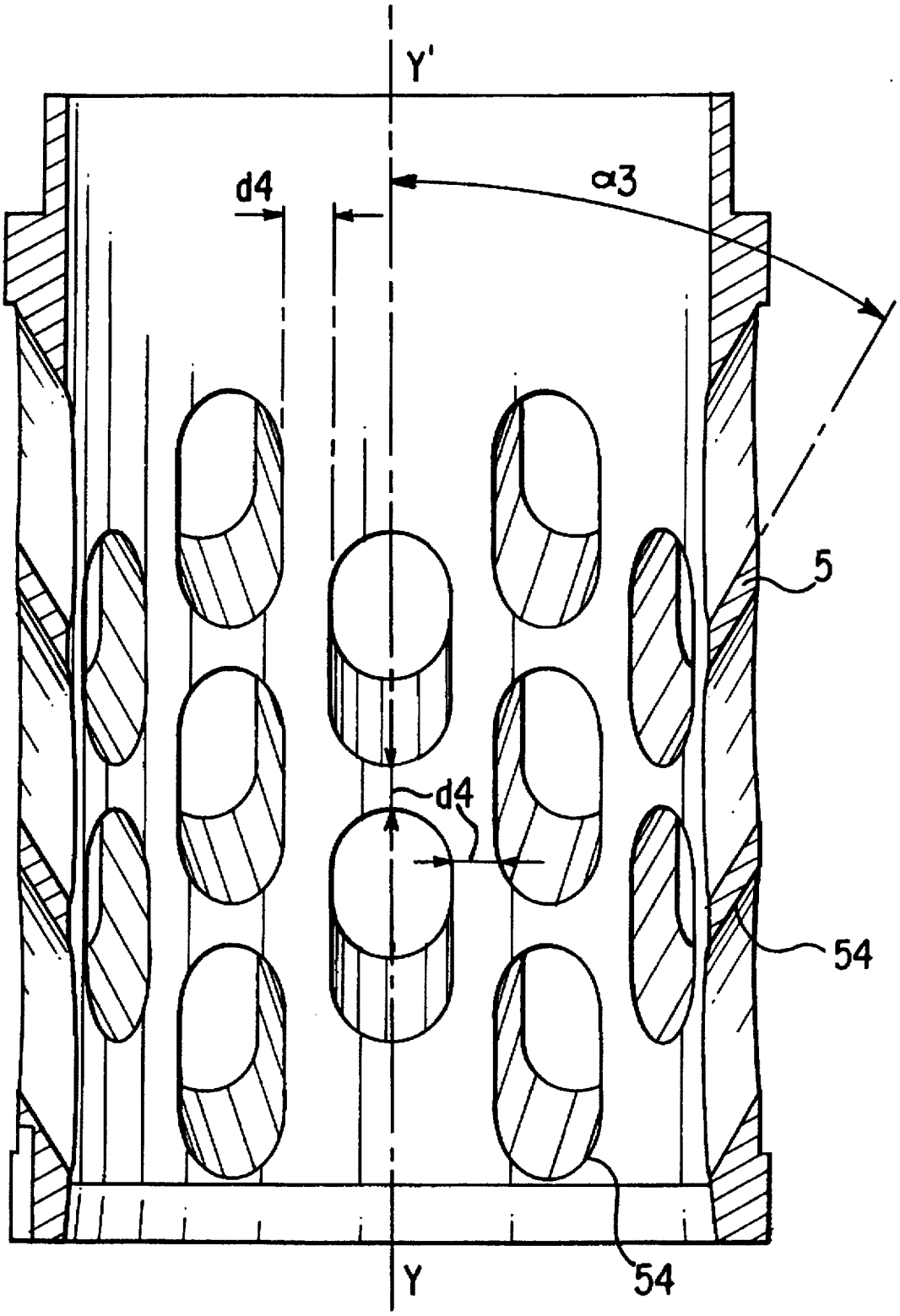
FIG. 3 shows a first embodiment of the vents.

FIG. 3 shows an alternative embodiment of the vents 54. These have an inner profile which opens out into the inner volume of the body 22, they are of an ovoid shape whose large axis is parallel to the axis of the barrel YY' and are inclined at an angle $\alpha 3$ with respect to the axis of the barrel YY' roughly equal to the angle $\alpha 2$ of the inner wall 22*a* of the body 22 with respect to the said axis YY'. For each vent, the large axis is between 15 and 40 mm and the small axis is between 10 and 15 mm. There must be as many vents 54 as possible so as to allow the best part of the propellant gases to pass through, however, the minimum distance d4 separating the said vents must be sufficient to withstand the pressure of the propellant gases.

Figure 4:
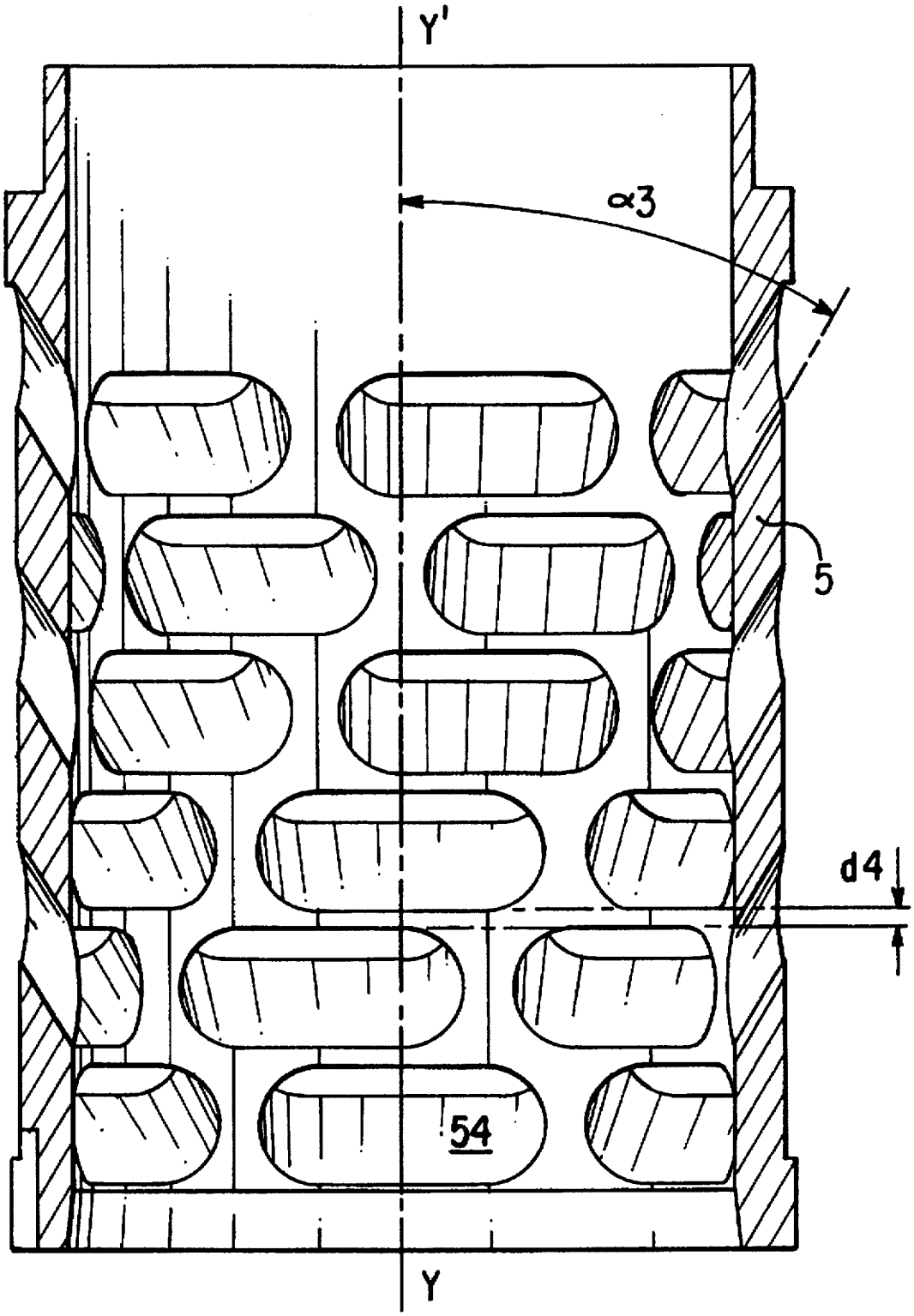
FIG. 4 shows a second embodiment of the vents.

FIG. 4 shows another embodiment of the vents 54. These are ovoid in shape and their large axis is perpendicular to the axis of the barrel YY'. They are inclined at an angle $\alpha 3$ with respect to the axis YY' of the barrel roughly equal to the angle $\alpha 2$ of the inner wall 22*a* of the body 22 with respect to the said axis YY'.

For each vent, the large axis is between 15 and 40 mm and the small axis is between 10 and 15 mm.

There must be as many vents 54 as possible so as to allow the best part of the propellant gases to pass through, however, the minimum distance d4 separating the said vents must be sufficient to withstand the pressure of the propellant gases.

Figure 5:
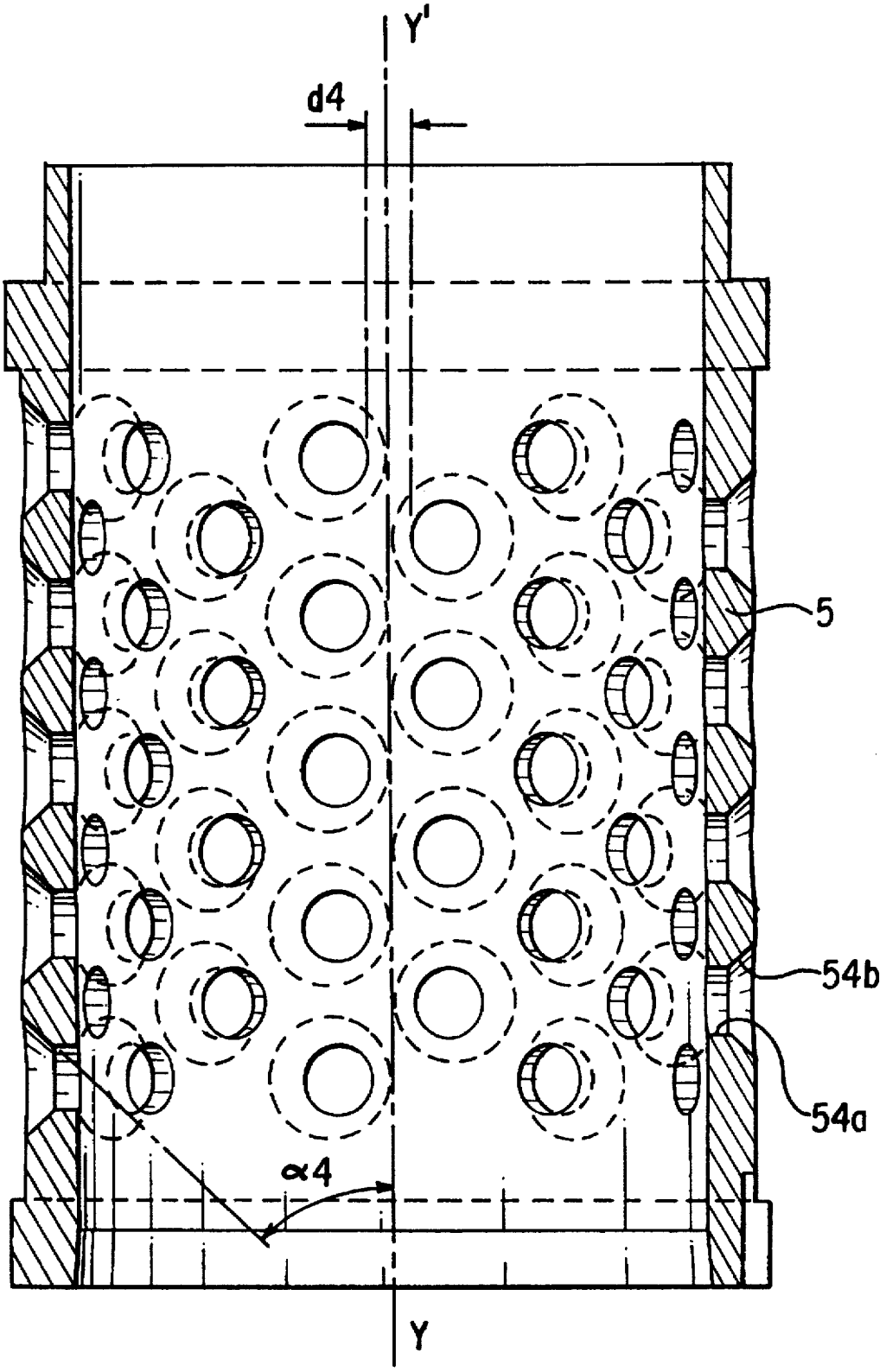
FIG. 5 shows a third embodiment of the vents.

FIG. 5 shows another embodiment of the vents 54 which have a cylindrical profile 54*a* of a diametre of between roughly 10 and 20 mm, opening out into the inner side of the liner 5 followed by a tapered profile 54*b* opening out onto the outer side of the said liner in the inner volume of the body 22. The angle of slope $\alpha 4$ with respect to the axis YY' of the barrel 30 of the tapered part 54*b* is roughly equal to the slope $\alpha 2$ of the inner wall 22*a* of the body 22 with respect to the said axis YY'. There must be as many vents 54 as possible so as to allow the best part of the propellant gases to pass through, however, the minimum distance d4 separating the said vents must be sufficient to withstand the pressure of the propellant gases.

This embodiment of the vents 54 has the advantage of being easier to manufacture industrially.

Figure 6:
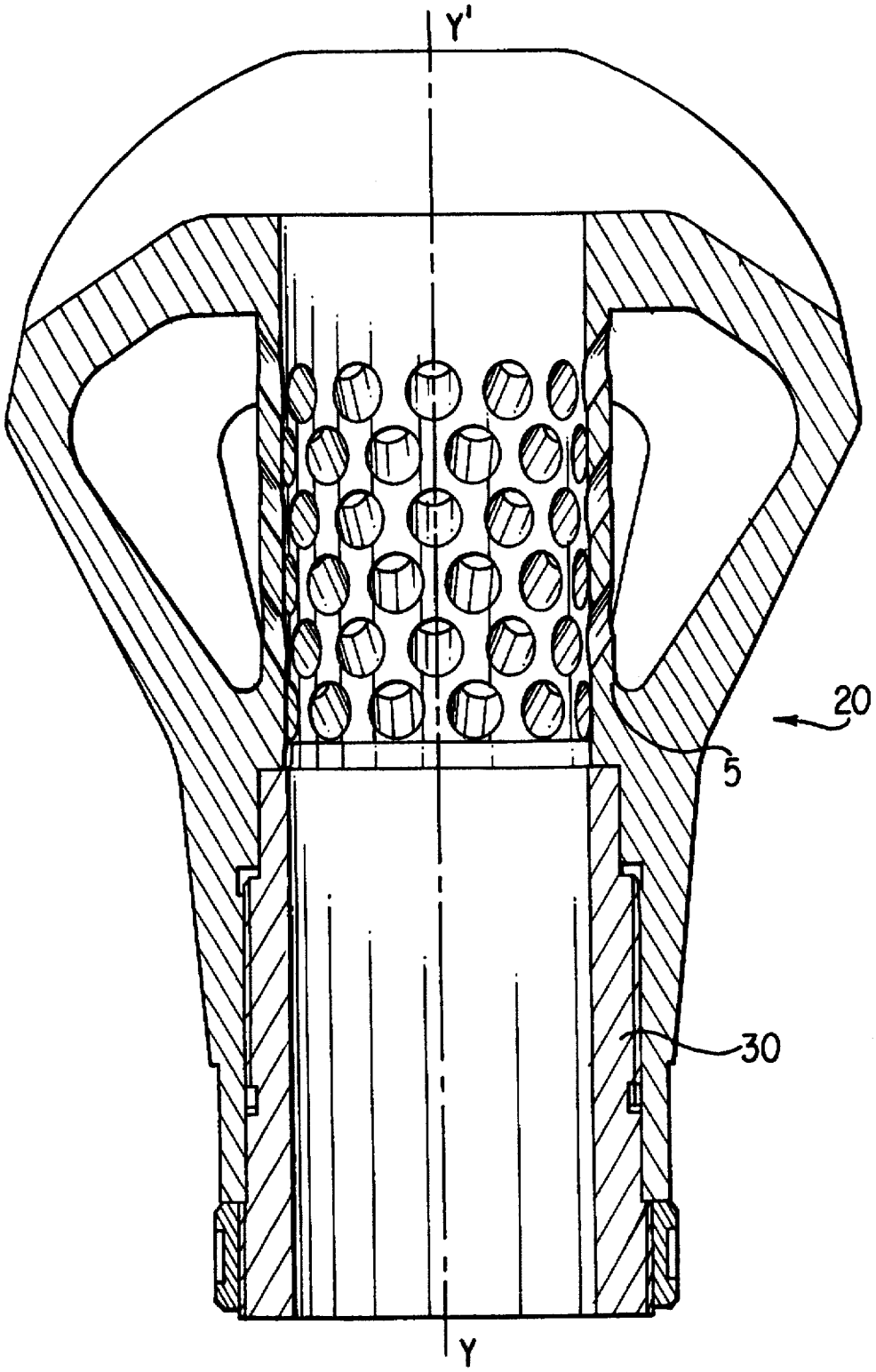
FIG. 6 shows a section view of a muzzle brake made in a single piece.

FIG. 6 shows an embodiment of the muzzle brake according to the invention in which the muzzle brake 20 and the tubular component 5 form a single piece which can be made from a casting blank, for example. This embodiment has proved to be particularly economic, as it does not require a liner 5 to be positioned with respect to the muzzle brake 20 and to the barrel 30.

Figure 7:
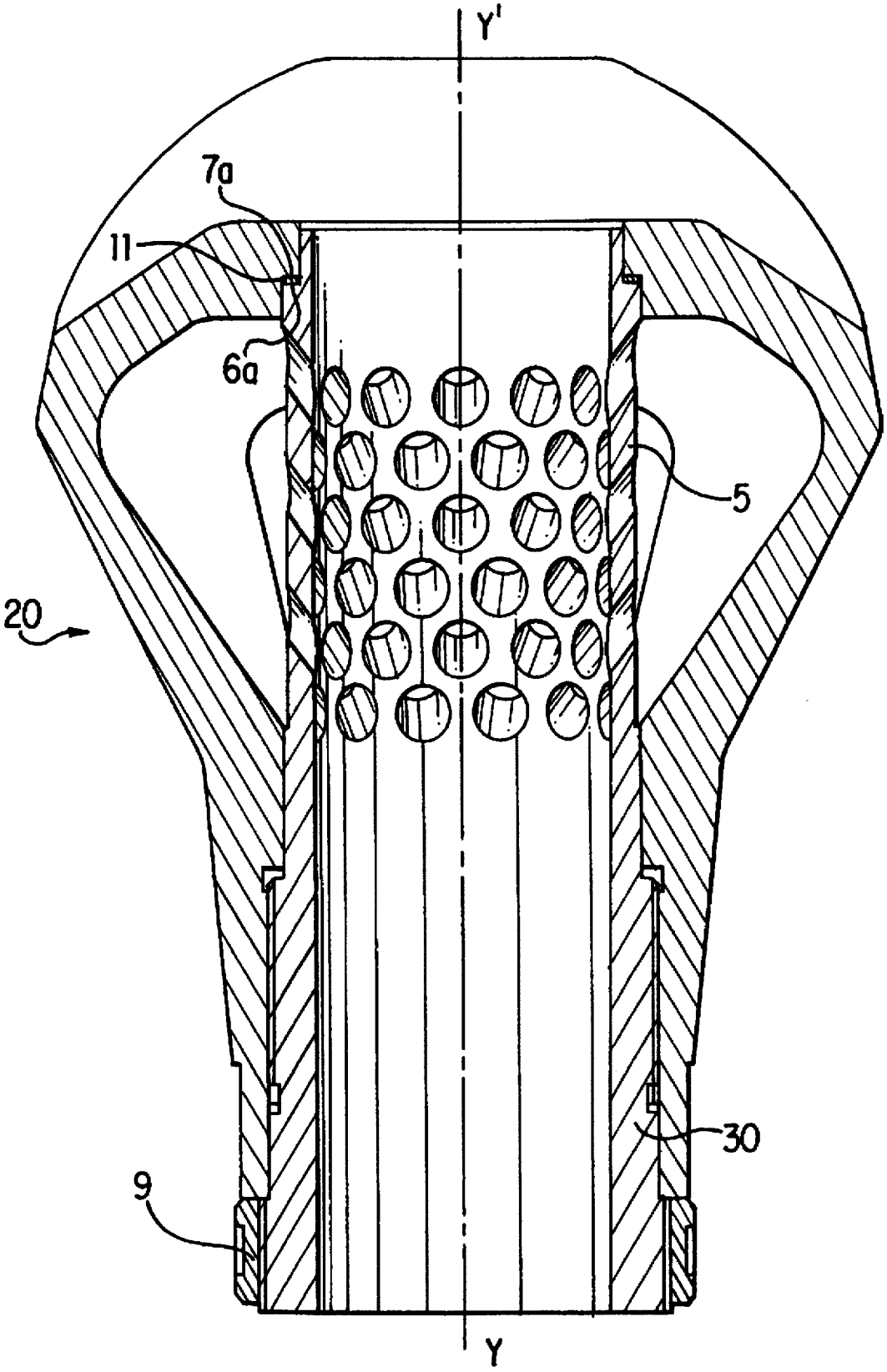
FIG. 7 shows a section view of a muzzle brake where the vents are pierced directly into the end of the barrel.

FIG. 7 shows an alternative to the muzzle brake according to the invention in which the tubular component 5 is formed of a single piece with the barrel 30. The muzzle brake is adjusted with respect to the barrel 30 in a known manner by means of a key (not shown) but of the type described with regards to FIG. 1. The axial play between the tubular component 5 and the muzzle brake 20 is cancelled by the slant of the face 6*c* of the tubular component 5 working in conjunction with the face 7*c* of the body 22 and with adjusting wedges 11 whose value is determined upon assembly.

We claim:

1. A muzzle brake for a barrel, the muzzle brake comprising:

a body including an inwardly-facing frustoconical part extending from an end of the barrel and having an inwardly-facing slope diverging relative to an axis of the barrel followed by an inwardly-facing converging part upon which propellant gases are directed to create a force in a direction opposite to a force generated by the propellant gases; and a tubular component prolonging a free end of the barrel engaged within the body, the tubular component being pierced with a plurality of vents extending along an axial direction of the tubular component for directing the propellant gases towards the converging part, the vents being inclined by an angle relative to the axis of the barrel that is substantially equal to the inwardly-facing diverging slope of the frustoconical part of the body.

2. The muzzle brake according to claim 1, wherein an inner wall of the tubular component is smooth, and the inner diameter of the tubular component is equal to a calibre of the barrel.

3. The muzzle brake according to claim 1, wherein an inner wall of the tubular component is smooth and the inner diameter of the tubular component is equal to the diameter at the bottom of barrel rifling.

4. The muzzle brake according to claim 1, wherein an inner wall Of the tubular component has rifling identical to barrel rifling provided on an inner surface of the barrel.

5. The muzzle brake according to claim 1, wherein the vents have a cylindrical inner profile of a diameter of between 10 and 20 mm.

6. The muzzle brake according to claim 1, wherein the vents have an ovoid inner profile with a large axis within a range of approximately between 15 and 40 mm and a small axis within a range of approximately between 10 and 15 mm.

7. The muzzle brake according to claim 1, wherein the vents have a cylindrical profile of a diameter within a range of approximately 10 and 20 mm opening out onto an inner side of the tubular component, and a tapered profile opening out onto an outer side of the tubular component.

8. The muzzle brake according to claim 1, wherein the tubular component has a thickness of between 5 and 10 mm and is made of steel having an elastic limit of around 1000 MPa.

9. The muzzle brake according to claim 8, wherein the tubular component is centered on an axis of the barrel by means of guiding supports at ends of the tubular component which work in conjunction with receiving supports formed on an inner wall of the body.

10. The muzzle brake according claim 1, wherein the tubular component ms immobilized with respect to the body by an immobilizing mechanism.

11. The muzzle brake according to claim 10, wherein the immobilizing mechanism is formed of a key and the tubular component is adjusted and immobilized in rotation with respect to the barrel by the key screwed in the body which works in conjunction with a groove formed in the tubular component and another groove made in the barrel.

12. The muzzle brake according to claim 1, wherein the tubular component is immobilized in translation with respect to the barrel by two shoulders, one of the two shoulders being located on a front end of the tubular component and the other of the two shoulders being located on a front part of the body, wherein adjusting wedges are housed between the two shoulders.

13. A muzzle brake for a barrel, the muzzle brake comprising:

body means for directing propellant gases to create a force in a direction opposite to a force generated by the propellant gases, the body means including an inwardly-facing frustoconical part extending from an end of the barrel and having an inwardly-facing slope diverging from an axis of the barrel followed by an inwardly-facing converging part upon which the propellant gases are directed; and tubular means for prolonging a free end of the barrel engaged within the body, the tubular means being pierced with a plurality of vents extending along an axial direction of the tubular component for directing the propellant gases towards the converging part, the vents being inclined by an angle relative to the axis of the barrel that is substantially equal to the inwardly-facing diverging slope of the frustoconical part of the body means.

* * * * *